US011222593B2

(12) United States Patent
Han

(10) Patent No.: US 11,222,593 B2
(45) **Date of Patent: *Jan. 11, 2022**

(54) PIXEL CIRCUIT FOR TOP-EMITTING AMOLED PANEL AND DRIVING METHOD THEREOF

(71) Applicant: Shenzhen China Star Optoelectronics Semiconductor Display Technology Co., Ltd., Guangdong (CN)

(72) Inventor: Baixiang Han, Shenzhen (CN)

(73) Assignee: SHENZHEN CHINA STAR OPTOELECTRONICS SEMICONDUCTOR DISPLAY TECHNOLOGY CO., LTD., Guangdong (CN)

( * ) Notice: Subject to any disclaimer, the term of this patent is extended or adjusted under 35 U.S.C. 154(b) by 0 days.

This patent is subject to a terminal disclaimer.

(21) Appl. No.: 17/106,201

(22) Filed: Nov. 30, 2020

(65) Prior Publication Data

US 2021/0082350 A1 Mar. 18, 2021

Related U.S. Application Data

(63) Continuation-in-part of application No. 15/579,948, filed on Dec. 6, 2017, now Pat. No. 10,891,898.

(30) Foreign Application Priority Data

Aug. 24, 2017 (CN) ..... 201710736699.1

(51) Int. Cl.
*G09G 3/3258* (2016.01)
*G09G 3/3266* (2016.01)

(52) U.S. Cl.
CPC ..... *G09G 3/3258* (2013.01); *G09G 3/3266* (2013.01)

(58) Field of Classification Search
None
See application file for complete search history.

(56) References Cited

U.S. PATENT DOCUMENTS 8,773,906 B2 * 7/2014 Ohmaru ..... H01L 27/1207 365/185.08
2010/0020065 A1 * 1/2010 Takasugi ..... G09G 3/3233 345/214

(Continued)

*Primary Examiner* — Benjamin C Lee
*Assistant Examiner* — Emily J Frank
(74) *Attorney, Agent, or Firm* — Leong C. Lei

(57) ABSTRACT

A top-emitting AMOLED panel includes a pixel circuit for each of multiple pixels. The circuit includes a first TFT connected to first, second, and third nodes; a second TFT connected to a scan signal, the first node and a data signal; a third TFT connected to the scan signal, the second node, and a reference voltage; a fourth TFT connected to the scan signal, the third node, and a high voltage power source; a first capacitor connected to the first node and the second node; a second capacitor connected to the third node and the reference voltage; and an OLED connected to the second node and a low voltage power source. The voltages supplied from the high voltage power source and the low voltage power source to the pixel are variable as functions of the location of the pixel on the panel, such that a voltage difference therebetween keeps unchanged.

6 Claims, 3 Drawing Sheets

(56) References Cited

U.S. PATENT DOCUMENTS

| | | | | |
|---|---|---|---|---|
| 2010/0103081 | A1* | 4/2010 | Takasugi | G09G 3/3233 345/45 |
| 2016/0086542 | A1* | 3/2016 | Lee | G09G 3/3225 345/212 |

* cited by examiner

PIXEL CIRCUIT FOR TOP-EMITTING AMOLED PANEL AND DRIVING METHOD THEREOF

CROSS REFERENCE TO RELATED APPLICATIONS

This is a continuation-in-part application of co-pending U.S. patent application Ser. No. 15/579,948, filed on Dec. 6, 2017, which is a national stage of PCT Application No. PCT/CN2017/111007, filed on Nov. 15, 2017, claiming foreign priority of Chinese Patent Application No. 201710736699.1, filed on Aug. 24, 2017, the disclosure of which is incorporated herein by reference in its entirety.

BACKGROUND OF THE INVENTION

1. Field of the Invention

The present invention relates to the field of display techniques, and in particular to a pixel circuit for top-emitting AMOLED panel and driving method thereof.

2. The Related Arts

The organic light-emitting diode (OLED) has the advantages of low power consumption, wide color gamut, high brightness, high resolution, wide viewing angle, and fast response time, and attracts much attention.

The driving types of OLED can be divided, according to the driving method, into the passive matrix OLED (PMOLED) and active matrix OLED (AMOLED); wherein the AMOLED provides the advantages of pixels arranged in an array, self-luminous, and high luminous efficiency and is commonly used for high definition large-size display. Based on the light-emission direction, the OLED can be either bottom-emitting type or top-emitting type. The light emitted from the top of the element for top-emitting OLED, and has a higher aperture ratio.

The large-size high-resolution AMOLED panel is the trend. As the resolution increases, the aperture area of the bottom-emitting AMOLED is greatly restricted. Hence, the development of top-emitting structure is imperative. The transparent cathode of the current large-size top-emitting AMOLED panel has a high impedance, resulting in serious IR drop.

Refer to FIG. 1. FIG. 1 shows a known AMOLED 3T1C pixel circuit, comprising: three thin film transistor (TFTs) T1-T3 and a capacitor Cst. The driving process of the pixel circuit is controlled by the scan signal Scan for timing sequence, and the TFT T1 is the driving TFT for driving the OLED by controlling the current flowing through the OLED.

The known AMOLED 3T1C pixel circuit operates as follows: When Scan is at high voltage, T2 and T3 are turned on, the data signal Data is written into node G, the reference voltage Ref(<OLED activation voltage) is written into node S, and Vgs=Data−Ref. At this point, OLED does not emit light. When Scan is at low voltage, T2 and T3 are cut-off, node S is charged to $V_{Anode}$ by the high voltage power source VDD, node G is coupled to Data+$V_{Anode}$−Ref. At this point, Vgs=Data−Ref, and the OLED starts to emit light. T1, as the driving TFT, needs to operate in the saturation zone, in other words, must satisfy Vgs−Vth<VDD−$V_{Anode}$, where Vth is the threshold voltage of T1. For large-size top-emitting AMOLED panel, if the low voltage power source VSS is limited by the high impedance of the transparent cathode and a larger IR voltage drop occurs, the VSS rises and causes the $V_{Anode}$ to rise, resulting in T1 operating in the linear zone, or $V_{Anode}$>VDD, the current pixel circuit is rendered failed.

SUMMARY OF THE INVENTION

The object of the present invention is to provide a pixel circuit for top-emitting AMOLED panel, to solve the circuit failure caused by the voltage raise of the low voltage power source VSS.

Another object of the present invention is to provide a driving method for the pixel circuit for top-emitting AMOLED panel, to solve the circuit failure caused by the voltage raise of the low voltage power source VSS.

To achieve the above object, the present invention provides a pixel circuit for top-emitting AMOLED panel, which comprises:

a first thin film transistor (TFT), having a gate connected to a first node, a source and a drain connected respectively to a second node and a third node;

a second TFT, having a gate connected to a scan signal, a source and a drain connected respectively to the first node and a data signal;

a third TFT, having a gate connected to the scan signal, a source and a drain connected respectively to the second node and a reference voltage;

a fourth TFT, having a gate connected to the scan signal, a source and a drain connected respectively to the third node and a high voltage power source;

a first capacitor, having two ends connected respectively to the first node and the second node;

a second capacitor, having two ends connected respectively to the third node and the reference voltage;

an OLED, having an anode connected to the second node, and a cathode connected to a low voltage power source;

wherein the high voltage power source having a voltage determined by the low voltage power source, voltage difference between the high voltage power source and the low voltage power source maintaining unchanged, the reference voltage being less than activation voltage of the OLED.

According to a preferred embodiment of the present invention, the scan signal has timing sequence configured for a compensation phase and a light-emitting phase.

According to a preferred embodiment of the present invention, in the compensation phase, the scan signal is at high voltage.

According to a preferred embodiment of the present invention, in the light-emitting phase, the scan signal is at low voltage.

According to a preferred embodiment of the present invention, the reference voltage maintains unchanged.

According to a preferred embodiment of the present invention, the first TFT, the second TFT, the third TFT and the fourth TFT are low temperature polysilicon (LTPS) TFTs or oxide semiconductor TFTs.

The present invention also provides a driving method for the aforementioned pixel circuit for top-emitting AMOLED panel, which comprises: the scan signal having timing sequence configured for a compensation phase and a light-emitting phase.

According to a preferred embodiment of the present invention, in the compensation phase, the scan signal is at high voltage.

According to a preferred embodiment of the present invention, in the light-emitting phase, the scan signal is at low voltage.

According to a preferred embodiment of the present invention, the reference voltage maintains unchanged.

The present invention also provides a pixel circuit for top-emitting AMOLED panel, which comprises:

a first thin film transistor (TFT), having a gate connected to a first node, a source and a drain connected respectively to a second node and a third node;

a second TFT, having a gate connected to a scan signal, a source and a drain connected respectively to the first node and a data signal;

a third TFT, having a gate connected to the scan signal, a source and a drain connected respectively to the second node and a reference voltage;

a fourth TFT, having a gate connected to the scan signal, a source and a drain connected respectively to the third node and a high voltage power source;

a first capacitor, having two ends connected respectively to the first node and the second node;

a second capacitor, having two ends connected respectively to the third node and the reference voltage;

an OLED, having an anode connected to the second node, and a cathode connected to a low voltage power source;

wherein the high voltage power source having a voltage determined by the low voltage power source, voltage difference between the high voltage power source and the low voltage power source maintaining unchanged, the reference voltage being less than activation voltage of the OLED;

wherein the scan signal having timing sequence configured for a compensation phase and a light-emitting phase;

wherein in the compensation phase, the scan signal being at high voltage;

wherein in the light-emitting phase, the scan signal being at low voltage;

wherein the reference voltage maintaining unchanged.

In summary, the pixel circuit for top-emitting AMOLED panel and driving method of the present invention can effectively relieve the IR voltage drop caused by impedance increase of the transparent cathode and solve the circuit failure problem caused by VSS voltage raise as well as keeping the voltage difference between VDD and VSS without increasing power consumption. As such, the present invention is applicable to large-size top-emitting AMOLED panel.

BRIEF DESCRIPTION OF THE DRAWINGS

To make the technical solution of the embodiments according to the present invention, a brief description of the drawings that are necessary for the illustration of the embodiments will be given as follows. Apparently, the drawings described below show only example embodiments of the present invention and for those having ordinary skills in the art, other drawings may be easily obtained from these drawings without paying any creative effort. In the drawings.

DETAILED DESCRIPTION OF THE PREFERRED EMBODIMENTS

Figure 1:
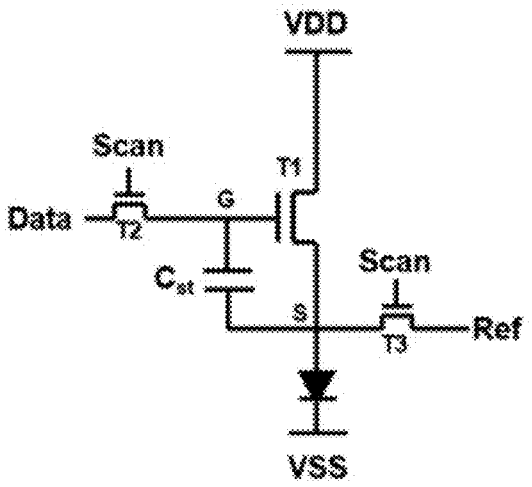
Fig. 1 Prior Art
FIG. 1 is a schematic view showing a known 3T1C pixel circuit of AMOLED.
Figure 2:
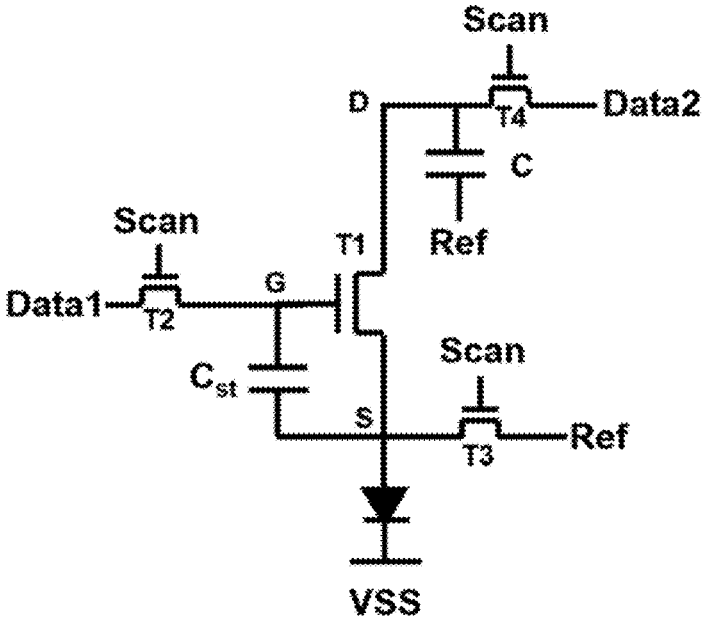
FIG. 2 is a schematic view showing the structure of a preferred embodiment of the pixel circuit for top-emitting AMOLED panel of the present invention.
Figure 3:
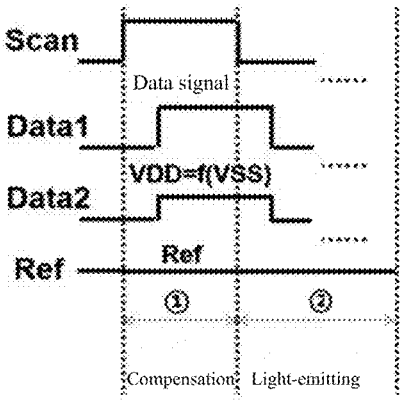
FIG. 3 is a schematic view showing the signal timing sequence of a preferred embodiment of the pixel circuit for top-emitting AMOLED panel of the present invention.

Referring to FIG. 2 and FIG. 3, FIG. 2 is a schematic view showing the structure of a preferred embodiment of a pixel circuit for each of multiple pixels that are arranged in a matrix form in top-emitting AMOLED panel of the present invention; FIG. 3 is a schematic view showing the signal timing sequence of the preferred embodiment of the pixel circuit of the top-emitting AMOLED panel of the present invention. The preferred embodiment is a 4T2C pixel circuit, comprising: four TFTs T1-T4, and two capacitor Cst and C; wherein T1 serving as a driving TFT, T1, having a gate connected to node G, a source and a drain connected respectively to node S and node D; T2, having a gate connected to scan signal Scan, a source and a drain connected respectively to node G and data signal Data1; T3, having a gate connected to scan signal Scan, a source and a drain connected respectively to node S and reference voltage Ref; T4, having a gate connected to scan signal Scan, a source and a drain connected respectively to node D and high voltage power source Data2; capacitor Cst, having two ends connected respectively to node G and node S; capacitor C, having two ends connected respectively to node D and reference voltage Ref; OLED, having an anode connected to node S, and a cathode connected to low voltage power source VSS. In this preferred embodiment, the high voltage power source Data2 has a voltage determined by the low voltage power source VSS, voltage difference between the high voltage power source Data2 and the low voltage power source VSS maintains unchanged, the reference voltage Ref is less than activation voltage of the OLED and maintains unchanged.

During operation, the scan signal Scan has timing sequenced configured for a compensation phase, also called programming phase, and a light-emitting phase. In compensation phase, the scan signal Scan is at high voltage, and in light-emitting phase, the scan signal Scan is at low voltage.

When Scan is at high voltage, T2, T3, and T4 are turned on, the high voltage power source Data2, specifically named VDD (a function of VSS), is written into node D, that is, the relationship between VDD and VSS can be expressed as VDD=f(VSS), stored in capacitor C; data signal Data1 is written into node G, and the reference voltage Ref(<activation voltage of OLED), Vgs=Data1−Ref, and the OLED does not emit light at this point.

When Scan is at low voltage, T2, T3, and T4 are cut-off. Because the capacitor C stores on the VDD voltage, capacitor C can be used as a voltage source. By design in advance a reasonable capacitance for the capacitor, the capacitor can be sure to provide power to OLED within the duration of a frame. As such, node S is charged by the VDD voltage stored at capacitor C in the capacitor C to $V_{Anode}$, where $V_{Anode}$ is the voltage at the anode of the OLED anode, node G is coupled to Data+$V_{Anode}$−Ref. At this point, Vgs=Data−Ref, and OLED starts to emit light.

Because this circuit is suitable for large-size top-emitting AMOLED panel, the impedance of the transparent cathode is very high, VSS has a serious IR voltage drop, which gets even more serious the closer to the center of the panel. The VDD is set to be a function of VSS and the value of VDD is determined according to VSS. As such, the driving TFT T1 can satisfy Vgs−Vth<VDD (=f(VSS))−$V_{Anode}$, where T1 operates in the saturation zone at this point and the panel can be driven normally. The function relationship between VDD and VSS can be as shown in FIG. 4, which can be determined in advance.

Figure 4:
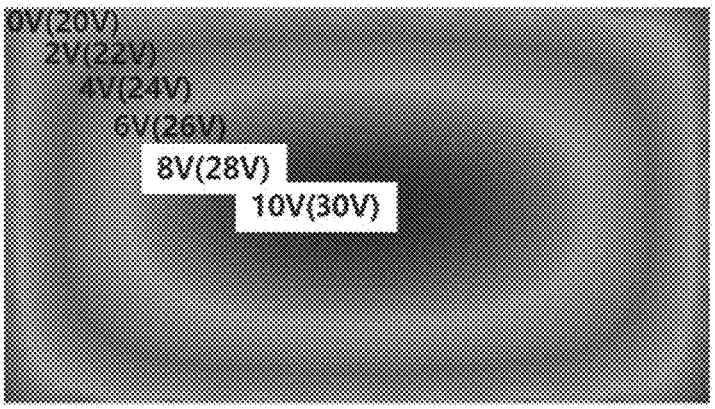
FIG. 4 is a schematic view showing an assumed VSS voltage distribution for a known 3T1C pixel circuit.

Referring to FIG. 4, FIG. 4 is a schematic view showing an assumed VSS voltage distribution for a known 3T1C pixel circuit. Assume that the initial voltage of VDD is 20V, the initial voltage of VSS is 0V, and the VSS IR voltage drop caused by the transparent cathode 10 is as the numbers outside of the parentheses shown in FIG. 4, the number is greater the closer to the center of the panel. The corresponding VDD voltage can be set as the number in the parentheses so that the voltage difference (VDD-VSS) of driver circuit in each zone keeps consistent, without increasing driving power consumption while solving the IR voltage drop issue caused by impedance increase of transparent cathode. In this regard, the present invention provides a solution to handle the issue of variation of VDD-VSS across the display panel shown in FIG. 4. The solution of the present invention is that as VSS varies with the location relative to for example an edge of the panel (or equivalently a distance from the edge of the panel), VDD is made varying according to the variation of VSS. In this way, VSS is variable as a function of location or distance relative to the edge of the panel, VDD is supplied as a function of VSS, and is thus a function of location or distance relative to the edge of the panel. In the example shown in FIG. 4, VSS increases from 0V at an edge of a panel (or a predetermined location on the panel) toward 10V at a location generally at or close to the center of the panel, and according to the variation of VSS, VDD is supplied from an initial value of 20V at the edge of the panel and increased to 30V at the location generally at or close to the center of the panel. In this way, this invention provides a solution in which VSS is supplied as being varied as a function of location on a panel or a distance measured from a predetermined location on the panel.

The present invention also provides a corresponding driving method for the pixel circuit. The core is to introduce independently controlled VDD voltages, and the VDD voltages and the VSS voltage distribution have a correspondence relation. The introduction of independently controlled VDD voltages effectively solves the problem of circuit failure caused by raised VSS voltage. By maintaining an unchanged voltage difference between VDD and VSS, no extra power consumption occurs. The pixel circuit for top-emitting AMOLED panel and driving method of the present comprises, but not limited to, LTPS process, oxide semiconductor process. Any similar process and resulted pixel circuit are also within the scope of the present invention. The present invention provides 4T2C pixel circuit, any variation of the TFT dimension, capacitance, and timing sequence is also within the scope of the present invention.

In summary, the pixel circuit for top-emitting AMOLED panel and driving method of the present invention can effectively relieve the IR voltage drop caused by impedance increase of the transparent cathode and solve the circuit failure problem caused by VSS voltage raise as well as keeping the voltage difference between VDD and VSS without increasing power consumption. As such, the present invention is applicable to large-size top-emitting AMOLED panel.

It should be noted that in the present disclosure the terms, such as, first, second are only for distinguishing an entity or operation from another entity or operation, and does not imply any specific relation or order between the entities or operations. Also, the terms "comprises", "include", and other similar variations, do not exclude the inclusion of other non-listed elements. Without further restrictions, the expression "comprises a . . . " does not exclude other identical elements from presence besides the listed elements.

Embodiments of the present invention have been described, but not intending to impose any unduly constraint to the appended claims. Any modification of equivalent structure or equivalent process made according to the disclosure and drawings of the present invention, or any application thereof, directly or indirectly, to other related fields of technique, is considered encompassed in the scope of protection defined by the claims of the present invention.

What is claimed is:

1. A top-emitting active matrix organic light-emitting diode (AMOLED) panel, which comprises multiple pixels arranged in a matrix, each of the pixels comprising a pixel circuit, which comprises:

a first thin film transistor (TFT), having a gate connected to a first node, a source and a drain connected respectively to a second node and a third node;

a second TFT, having a gate connected to a scan signal, a source and a drain connected respectively to the first node and a data signal;

a third TFT, having a gate connected to the scan signal, a source and a drain connected respectively to the second node and a reference voltage;

a fourth TFT, having a gate connected to the scan signal, a source and a drain connected respectively to the third node and a high voltage power source that supplies a first voltage;

a first capacitor, having two ends connected respectively to the first node and the second node;

a second capacitor, having two ends connected respectively to the third node and the reference voltage;

an OLED, having an anode connected to the second node, and a cathode connected to a low voltage power source that supplies a second voltage different from the first voltage, wherein the second voltage of the low voltage power source has a value that is variable across the top-emitting AMOLED panel and exhibits as a function of a location of the pixel circuit on the top-emitting AMOLED;

wherein the first voltage of the high voltage power source has a value determined as a function of the value of the second voltage of the low voltage power source, wherein the value of the first voltage of the high voltage power source is variable across the top-emitting AMOLED panel and a difference between the first voltage of the high voltage power source and the second voltage of the low voltage power source keeps unchanged across the top-emitting AMOLED panel, wherein the first voltage of the high voltage power source is supplied such that the value of the first voltage of the high voltage power source varies as a function of the location of the pixel on the top-emitting AMOLED.

2. The top-emitting AMOLED panel as claimed in claim 1, wherein the scan signal has timing sequence configured for a compensation phase and a light-emitting phase.

3. The top-emitting AMOLED panel as claimed in claim 2, wherein in the compensation phase, the scan signal is at high voltage.

4. The top-emitting AMOLED panel as claimed in claim 2, wherein in the light-emitting phase, the scan signal is at low voltage.

5. The top-emitting AMOLED panel as claimed in claim 1, wherein the reference voltage maintains unchanged.

6. The top-emitting AMOLED panel as claimed in claim 1, wherein the first TFT, the second TFT, the third TFT and the fourth TFT are low temperature polysilicon (LTPS) TFTs or oxide semiconductor TFTs.

* * * * *